US007418950B2

(12) United States Patent
Teets et al.

(10) Patent No.: US 7,418,950 B2
(45) Date of Patent: Sep. 2, 2008

(54) FUEL PUMP AND TANK ASSEMBLY FOR AN AUTOMOTIVE VEHICLE

(75) Inventors: Michael R Teets, Grosse Pointe Park, MI (US); Trevor Enge, West Bloomfield, MI (US); Robert W Schmidt, Novi, MI (US); Lavern M Bremmer, Dexter, MI (US)

(73) Assignee: Chrysler LLC, Auburn Hills, MI (US)

( * ) Notice: Subject to any disclaimer, the term of this patent is extended or adjusted under 35 U.S.C. 154(b) by 60 days.

(21) Appl. No.: 11/315,604

(22) Filed: Dec. 22, 2005

(65) Prior Publication Data

US 2007/0144495 A1 Jun. 28, 2007

(51) Int. Cl.
*F02M 37/04* (2006.01)
*E03B 11/00* (2006.01)

(52) U.S. Cl. ..... 123/509; 137/590

(58) Field of Classification Search ..... 137/574, 137/626, 590; 123/509
See application file for complete search history.

(56) References Cited

U.S. PATENT DOCUMENTS 3,330,439 A * 7/1967 Moorman ..... 220/86.2
3,917,109 A * 11/1975 MacDonald ..... 220/746
4,638,836 A * 1/1987 Bailey ..... 137/574
4,750,518 A * 6/1988 Griffin et al. ..... 137/565.17
4,844,704 A 7/1989 Jiro
4,919,103 A * 4/1990 Ishiguro et al. ..... 123/514
5,044,526 A 9/1991 Sasaki et al.
5,070,849 A 12/1991 Rich et al.
5,080,077 A 1/1992 Sawert et al.
5,127,432 A * 7/1992 Duhaime et al. ..... 137/574
5,415,146 A 5/1995 Tuckey
5,522,425 A * 6/1996 Kroiss et al. ..... 137/590
5,560,342 A 10/1996 Fournier et al.
5,596,970 A 1/1997 Schoenberg et al.
5,642,719 A 7/1997 Brown
5,647,328 A * 7/1997 Fournier et al. ..... 123/509
5,669,359 A 9/1997 Kleppner et al.
5,762,047 A * 6/1998 Yoshioka et al. ..... 123/509
6,000,913 A 12/1999 Chung et al.
6,014,957 A 1/2000 Robinson
6,609,503 B1 * 8/2003 Nakagawa et al. ..... 123/509

* cited by examiner

*Primary Examiner*—Stephen K. Cronin
*Assistant Examiner*—J. Page Hufty
(74) *Attorney, Agent, or Firm*—Ralph E. Smith

(57) ABSTRACT

A fuel tank assembly includes a fuel tank having a plurality of side walls spaced apart by a floor. A flange extends downward from one of the plurality of side walls at an angle toward the floor. A fuel pump extends from the flange; the fuel pump and flange are arranged to fixedly position at least one inlet connected to the fuel pump at or in close proximity to the floor of the fuel tank. A fuel dam extends away from the floor and has at least one passage formed therein. The fuel dam is positioned so as to create an accumulated area of the fuel tank surrounding the at least one inlet. Fuel enters the accumulated area through the at least one passage and is received by the at least one inlet.

14 Claims, 4 Drawing Sheets

FUEL PUMP AND TANK ASSEMBLY FOR AN AUTOMOTIVE VEHICLE

FIELD OF THE INVENTION

The present invention relates to fuel tank assemblies and more particularly to a fuel pump and tank assembly for an automotive vehicle.

BACKGROUND OF THE INVENTION

In automotive vehicles, a fuel pump is typically disposed within a fuel tank assembly. The fuel pump draws fuel from the fuel tank through the fuel lines for supply to the engine. Known fuel tanks utilize top-mounted fuel pumps having an inlet arranged to receive fuel from a separately constructed reservoir tank arranged within the fuel tank, i.e. a tank within a tank. Such arrangements use supplemental pumps that are arranged to transfer fuel from the fuel tank to the reservoir tank, thus requiring additional mechanical energy. Consequently, such fuel tank assemblies utilizing top mounted fuel pumps tend to be more costly to assemble and difficult to access for service.

Thus, there exists a need for a fuel pump and tank assembly that overcomes these and other disadvantages.

SUMMARY OF THE INVENTION

Accordingly, one aspect of the present invention is to provide a fuel tank assembly comprising a fuel tank having a plurality of side walls spaced apart by a floor. A flange extends downward from one of the plurality of side walls at an angle toward the floor. A fuel pump extends from the flange; the fuel pump and flange are arranged to fixedly position at least one inlet connected to the fuel pump at or in close proximity to the floor of the fuel tank. A fuel dam extends away from the floor and has at least one passage formed therein. The fuel dam is positioned within the fuel tank so as to create an accumulated area surrounding the at least one inlet. Fuel enters the accumulated area through the at least one passage and is received by the at least one inlet.

According to a second aspect of the present invention, a fuel tank is provided comprising a plurality of side walls separated by a floor. The floor is arranged to slope downward between the side walls. A fuel dam consists of a partition extending away from the floor, and has at least one passage formed therein. The fuel dam is positioned within the fuel tank so as to create an accumulated area of the fuel tank. Fuel enters the accumulated area through the at least one passage.

According to a third aspect of the present invention, a vehicle is provided having a fuel tank having a plurality of side walls separated by a floor. The floor is arranged to slope downward from one side wall to another side wall. A flange extends downward from one of the plurality of side walls at an angle toward the floor. A fuel pump extends from the flange; the fuel pump and flange are arranged to fixedly position at least one inlet connected to the fuel pump at or in close proximity to the floor. A fuel dam extends away from the floor and has at least one passage formed therein. The fuel dam is positioned within the fuel tank so as to create an accumulate area of the fuel tank surrounding the at least one inlet. Fuel enters the accumulated area through the at least one passage and is received by the at least one inlet.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

Figure 1:
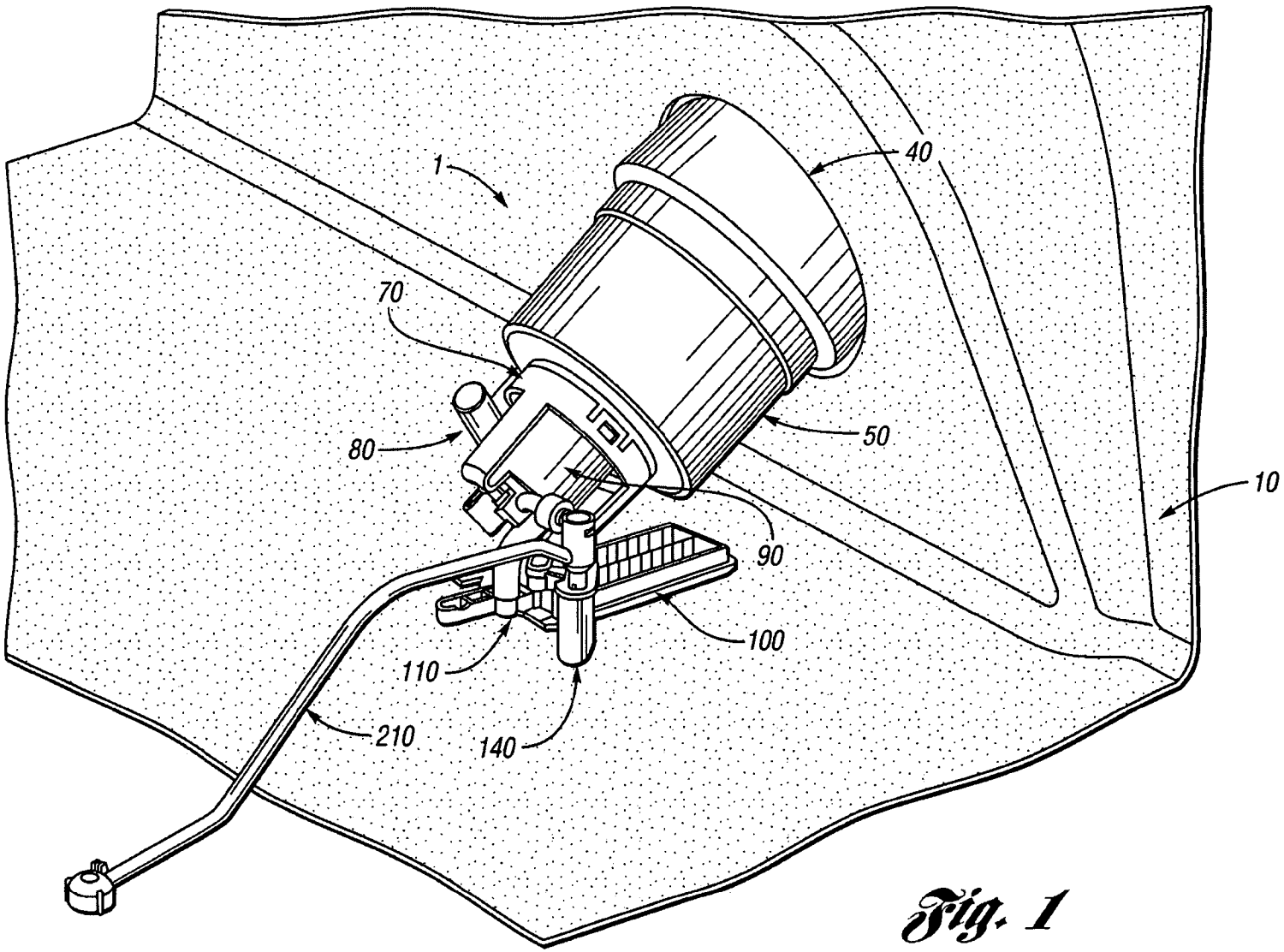
FIG. 1 shows a perspective view of a fuel tank assembly according to the present invention.
Figure 2:
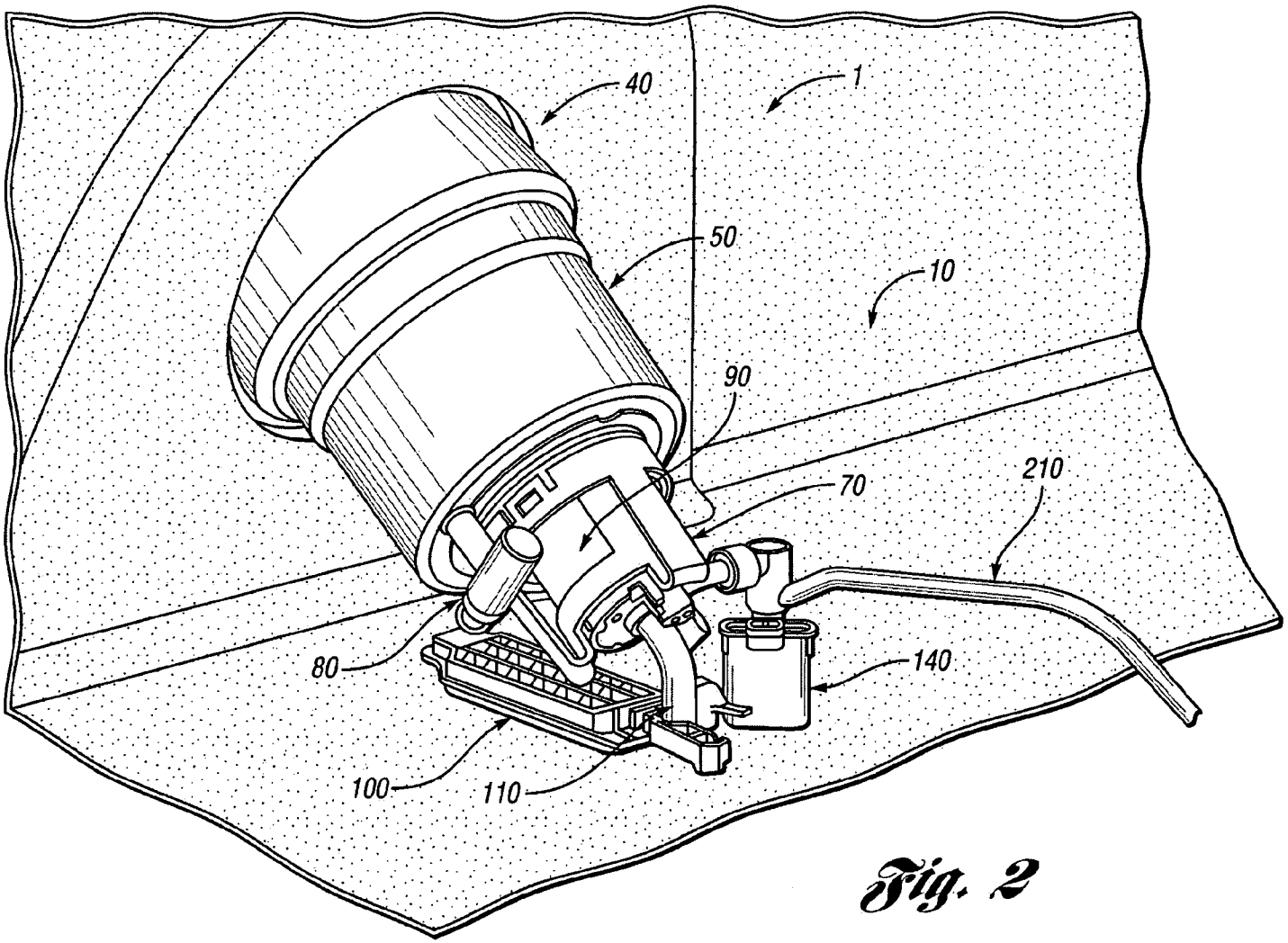
FIG. 2 shows an alternate perspective view of a fuel tank assembly according to the present invention.
Figure 3:
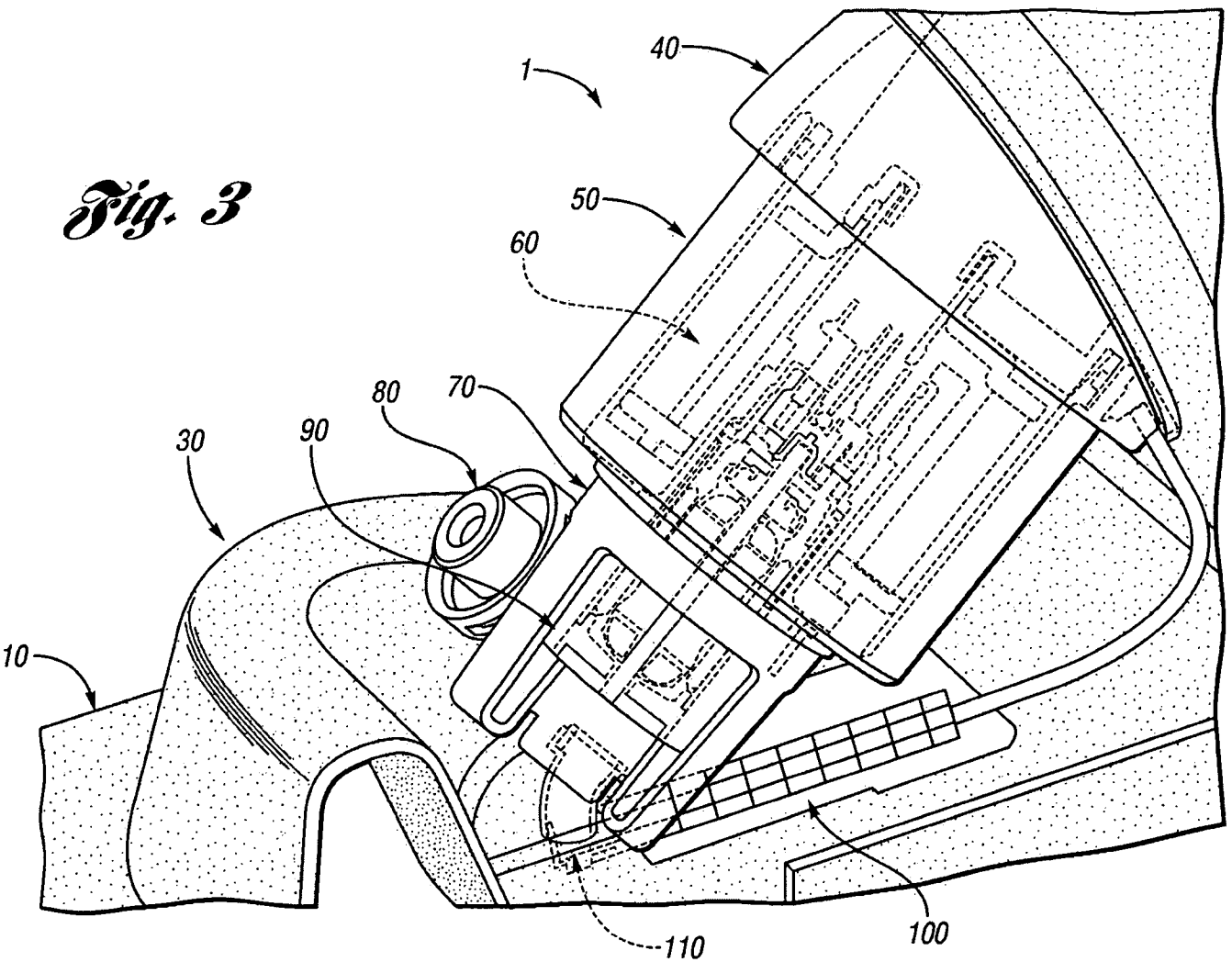
FIG. 3 shows a perspective view of a fuel tank assembly having a fuel dam according to the present invention.

Referring to FIGS. 1 and 2, a fuel pump assembly 1 according to an exemplary embodiment is shown. The fuel pump assembly 1 includes a flange 40, a filter housing 50, a pump retainer 70, a fuel pressure regulator 80, and a pump 90. The flange 40 is further positioned on a side wall of a fuel tank 10. According to an exemplary embodiment, the filter housing 50 contains a fuel filter 60 (as shown in FIG. 3), and is disposed between the flange 40 and the pump 90. The pump retainer 70 is attached at an end of the filter housing 50 opposite the flange 40. The fuel pressure regulator 80 is attached to the pump retainer 70.

In accordance with an aspect of the present invention, the flange 40 can be positioned on a side wall of fuel tank 10 that is arranged to be adjacent to a vehicle exterior member (not shown) when the fuel pump assembly 1 and fuel tank 10 are installed in a vehicle chassis (not shown). This arrangement enables the fuel pump assembly 1 to be accessed simply by removing, for example, a rear quarter panel (not shown) of a vehicle.

The fuel pump assembly 1 may further include an additional fuel filter, or filter sock, 100 in fluid communication with a pump inlet 110 and pump 90. The fuel pump assembly 1 may also include a local jet pump 140 in fluid communication with the pump 90, and at least one remote jet pump 210 in fluid communication with pump 90. In accordance with the present invention, the flange 40 positions the filter sock 100, inlet 110, and jet pumps 140, 210 on the floor of the fuel tank 10 by virtue of its orientation and position on the side wall of the fuel tank 10. Therefore, flange 40 eliminates the need for biasing devices such as springs, hinges, and other moving parts.

Figure 4:
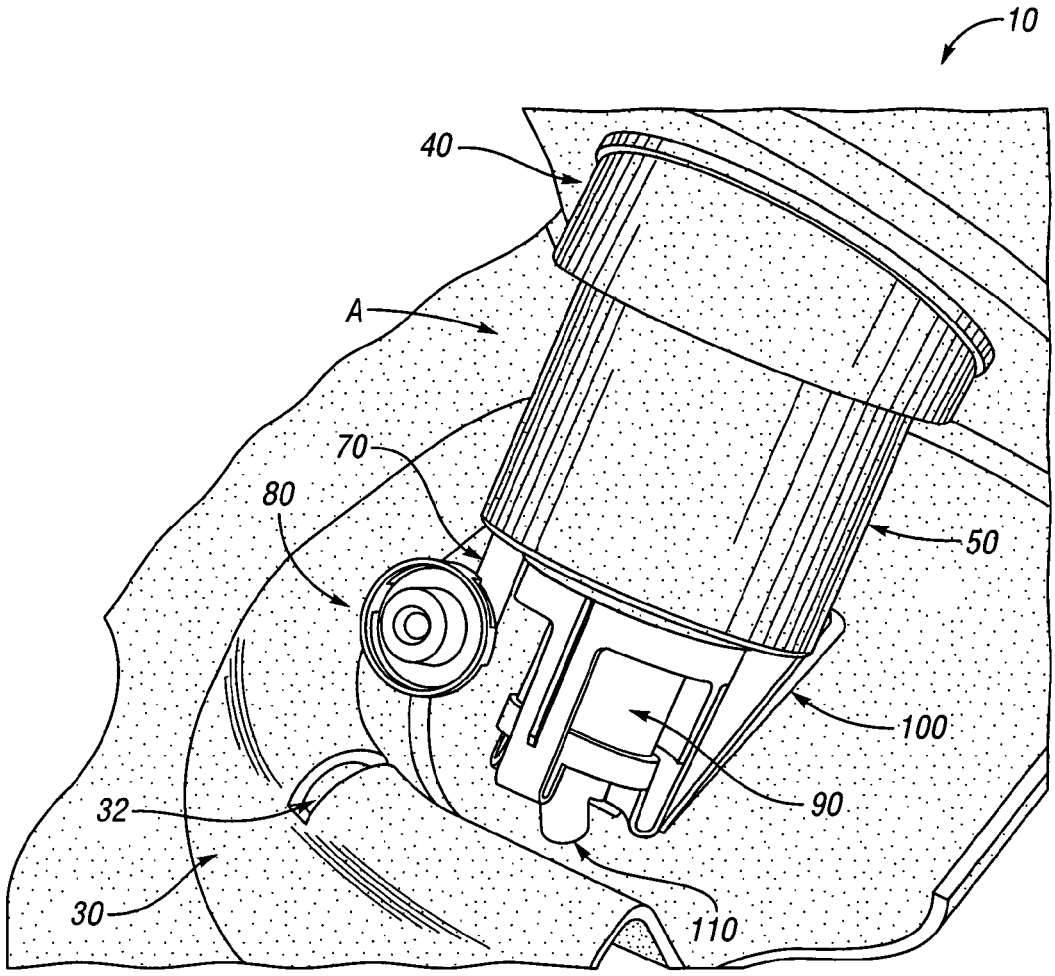
FIG. 4 shows an alternate perspective view of a fuel tank assembly having a fuel dam according to the present invention.
Figure 5:
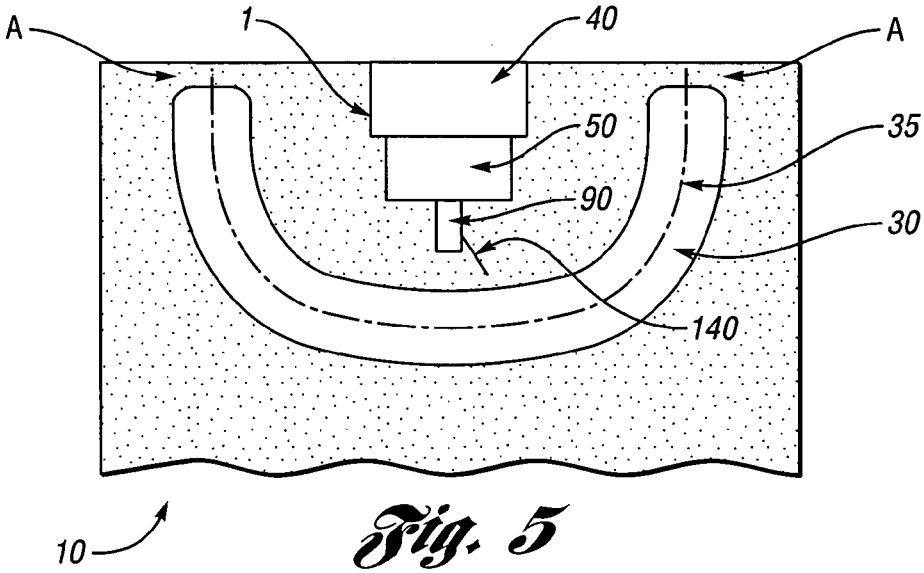
FIG. 5 shows a top view of a fuel tank assembly having a fuel dam according to the present invention.

Referring to FIGS. 3, 4 and 5, the fuel tank 10 is shown according to a first exemplary embodiment to include a fuel dam 30 positioned on the floor of the fuel tank 10. According to an aspect of the present invention, the fuel dam 30 can be an integrally molded or formed partition extending upward from the floor of the fuel tank 10, and following a path 35 that generally encircles the fuel pump assembly 1. The fuel dam 30 further extends from a side wall of the fuel tank 10 and encloses the fuel pump assembly 1 against the side wall, as shown, for example in FIG. 5. According to a second exemplary embodiment, the fuel dam 30 extends from one side wall to another side wall of the fuel tank 10 and encloses the fuel pump assembly 1 in a corner of the fuel tank 10. In accordance with another aspect of the present invention, the fuel dam 30 also includes at least one channel 32 for receiving at least one remote inlet 210.

According to either exemplary embodiment, the floor of the fuel tank 10 is sloped downward in the direction of the fuel pump assembly 1. In addition, the fuel dam 30 includes a passage allowing fuel to enter an accumulated, or "pooled", area. According to an aspect of the present invention, the passage can be formed by the height of the fuel dam 30 generally decreasing along the path 35 and becoming negligible as the path approaches the side wall of the fuel tank 10. As a result, fuel (not shown) will flow around the fuel dam 30 and into an area enclosed by the fuel dam 30, according to arrow A (best seen in FIG. 5). Furthermore, the fuel dam 30 is arranged to retain a quantity of fuel within an area defined by the path 35. This arrangement is relevant when small quantities of fuel remain in the fuel tank 10 as the floor and the fuel dam 30 ensure that fuel remains available to filter sock 100, inlet 110 and jet pump 140 without the use of a reservoir within the tank.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel tank assembly comprising:

a fuel tank having a plurality of side walls spaced apart by a floor;

a flange extending downward from one of the plurality of side walls at an angle toward the floor;

a fuel pump extending from the flange, the flange and fuel pump being arranged to fixedly position at least one inlet connected to the fuel pump at or in close proximity to the floor of the fuel tank; and a fuel dam extending away from the floor having at least one passage formed therein, the fuel dam positioned within the fuel tank so as to create an accumulated area of the fuel tank surrounding the at least one inlet and enclosing the at least one inlet against at least one of said plurality of side walls;

wherein fuel enters the accumulated area through the at least one passage for receipt by the at least one inlet.

2. The fuel tank assembly of claim 1 further including a plurality of inlets for receiving fuel from the fuel tank, the plurality of inlets being in fluid communication with the pump and arranged to be at or in close proximity to the floor of the fuel tank.

3. The fuel tank assembly of claim 1 further including a fuel filter positioned on the floor of the fuel tank, the fuel filter being in fluid communication with the at least one inlet.

4. The fuel tank assembly of claim 1 further including a filter housing enclosing a fuel filter disposed between the flange and the fuel pump.

5. The fuel tank assembly of claim 1 further including a pump retainer extending from the flange for support the fuel pump.

6. The fuel tank assembly of claim 5 further including a fuel pressure regulator mounted to the pump retainer for regulating the pressure of fuel flow traveling from the fuel tank to an engine.

7. A fuel tank assembly comprising:

a fuel tank having a plurality of side walls, and a floor positioned there between, the floor arranged from one side wall to another side wall;

a fuel dam comprising a partition extending away from the floor having at least one passage formed therein, the fuel dam positioned within the fuel tank so as to create an accumulated area of the fuel tank and adapted to enclose at least one inlet of a fuel pump against one of said plurality of side walls, wherein the fuel dam has a predetermined height relative to the floor that decreases along a path of the fuel dam defining the enclosed area, the predetermined height becoming negligible prior to the dam reaching one of the plurality of side walls; and a fuel filter positioned on the floor and arranged within the path of the fuel dam, the fuel filter in fluid communication with the at least one inlet of the fuel pump, wherein fuel enters the accumulated area through the at least one passage, wherein the fuel dam further includes at least one channel arranged to receive at least one fuel pickup.

8. The fuel tank assembly of claim 7 wherein the accumulated area comprises a corner between two of the plurality of side walls, the fuel dam extending between the two side walls.

9. The fuel tank assembly of claim 7 wherein the fuel dam follows the path, which includes an arcuate path extending from one of the plurality of side walls.

10. The fuel tank assembly of claim 7 wherein the partition is formed integrally with the floor of the fuel tank.

11. The fuel tank assembly of claim 7 wherein the fuel pump further includes at least one fuel pickup arranged within the accumulated area.

12. A vehicle comprising:

a fuel tank having a plurality of side walls separated by a floor, the floor arranged from one side wall to another side wall;

a flange extending downward from one of the plurality of side walls at an angle toward the floor:

a fuel pump extending from the flange, the fuel pump and flange being arranged to fixedly position at least one inlet connected to the fuel pump at or in close proximity to the floor, and a fuel dam extending away from the floor having at least one passage formed therein, the fuel dam positioned within the fuel tank so as to create an accumulated area of the fuel tank surrounding the at least one inlet and enclosing the at least one inlet against one of said plurality of side walls;

wherein fuel enters the accumulated area through the at least one passage for receipt by the at least one inlet.

13. The vehicle of claim 12 further including a filter sock positioned on the floor and arranged within a path of the fuel dam, the filter sock in fluid communication with the at least one inlet of the fuel pump.

14. A fuel tank assembly comprising:

a fuel tank having a plurality of side walls spaced apart by a floor;

a flange extending downward from one of the plurality of side walls at an acute angle with respect to said side wall toward the floor;

a fuel pump extending from the flange, the flange and fuel pump being arranged to fixedly position at least one inlet connected to the fuel pump at or in close proximity to the floor of the fuel tank; and a fuel dam comprising a U-shaped elevation within the floor having at least one low area that defines a passage, the fuel dam positioned within the fuel tank so as to create an accumulated area of the fuel tank surrounding the at least one inlet and enclosing the at least one inlet against one of said plurality of side walls;

wherein fuel enters the accumulated area through the at least one passage for receipt by the at least one inlet.

* * * * *